US007967700B2

(12) United States Patent
Stites

(10) Patent No.: US 7,967,700 B2
(45) Date of Patent: Jun. 28, 2011

(54) GOLF CLUB HEAD OR OTHER BALL STRIKING DEVICE HAVING ADJUSTABLE STIFFENED FACE PORTION

(75) Inventor: John Thomas Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/261,875

(22) Filed: Oct. 30, 2008

(65) Prior Publication Data

US 2010/0113178 A1 May 6, 2010

(51) Int. Cl.
*A63B 53/04* (2006.01)
*A63B 53/06* (2006.01)

(52) U.S. Cl. ..... 473/342; 473/346

(58) Field of Classification Search ..... 473/324–350
See application file for complete search history.

(56) References Cited

U.S. PATENT DOCUMENTS 4,067,572 A * 1/1978 Coleman ..... 473/245
4,535,990 A * 8/1985 Yamada ..... 473/346
5,464,211 A * 11/1995 Atkins, Sr. ..... 473/377
5,669,829 A * 9/1997 Lin ..... 473/346
5,683,309 A * 11/1997 Reimers ..... 473/337
5,890,973 A * 4/1999 Gamble ..... 473/326
5,916,042 A * 6/1999 Reimers ..... 473/334
6,015,354 A 1/2000 Ahn et al.
6,299,547 B1 * 10/2001 Kosmatka ..... 473/329
6,348,013 B1 * 2/2002 Kosmatka ..... 473/329
6,458,043 B1 * 10/2002 McCabe et al. ..... 473/330
6,471,604 B2 * 10/2002 Hocknell et al. ..... 473/334
6,595,869 B2 * 7/2003 McCabe et al. ..... 473/330
6,602,149 B1 * 8/2003 Jacobson ..... 473/329
6,648,774 B1 * 11/2003 Lee ..... 473/342
6,739,983 B2 * 5/2004 Helmstetter et al. ..... 473/342
6,964,617 B2 * 11/2005 Williams ..... 473/245
7,140,977 B2 * 11/2006 Atkins, Sr. ..... 473/346
7,192,364 B2 * 3/2007 Long ..... 473/329
7,247,104 B2 * 7/2007 Poynor ..... 473/329
7,367,897 B2 * 5/2008 Poynor ..... 473/329
7,384,348 B2 * 6/2008 Lin et al. ..... 473/332
7,387,579 B2 * 6/2008 Lin et al. ..... 473/332
2003/0190975 A1 10/2003 Fagot (Continued)

FOREIGN PATENT DOCUMENTS

JP 7231957 9/1995

(Continued)

OTHER PUBLICATIONS

International Search Report and Written Opinion for PCT Application No. PCT/US2009/062599 mailed Jul. 9, 2010.

*Primary Examiner* — Alvin A Hunter
(74) *Attorney, Agent, or Firm* — Banner & Witcoff, Ltd.

(57) ABSTRACT

A ball striking device, such as a golf club head, has a head that includes a face configured for striking a ball and a body connected to the face, the body being adapted for connection of a shaft thereto. The head may include one or more stiffening elements or other structures engaging the face to provide locally increased stiffness to particular areas of the face. The stiffening element can be movable to create regions of increased stiffness in desired locations, leaving other regions of the face to have increased flexibility as compared to the stiffened regions.

32 Claims, 11 Drawing Sheets

U.S. PATENT DOCUMENTS

| | | | | |
|---|---|---|---|---|
| 2004/0132541 | A1 | 7/2004 | Macllraith | |
| 2006/0154741 | A1 * | 7/2006 | Shieh | 473/342 |

FOREIGN PATENT DOCUMENTS

| | | | | |
|---|---|---|---|---|
| JP | 2002320692 | A | * | 11/2002 |
| JP | 2003339921 | A | * | 12/2003 |
| JP | 2004033536 | A | * | 2/2004 |
| JP | 2004237039 | A | * | 8/2004 |
| JP | 2006320493 | A | * | 11/2006 |
| JP | 2007007063 | A | * | 1/2007 |
| JP | 2007029588 | A | * | 2/2007 |
| JP | 2007044279 | | | 2/2007 |

* cited by examiner

GOLF CLUB HEAD OR OTHER BALL STRIKING DEVICE HAVING ADJUSTABLE STIFFENED FACE PORTION

TECHNICAL FIELD

The invention relates generally to ball striking devices, such as golf club heads, having a stiffened portion on the ball striking face thereof. Certain aspects of this invention relate to golf club heads having a stiffening element that is movable to create areas of increased face stiffness in desired locations.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Like other golf clubs, drivers and other "woods" also must make square contact with the golf ball, in the desired direction or path, in order to produce straight and true shots in the desired direction. Even small deviations from squareness between the club head and the golf ball at the point of contact can cause inaccuracy. Because drivers and other wood-type golf clubs typically launch the ball over greater distances than other clubs, these inaccuracies can be exaggerated.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss in other areas of the club face. Because golf clubs are typically designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Accordingly, a need exists to customize or adjust the local flexibility of a golf club face to provide maximized COR in the areas of the face where off-center hits tend to occur most, without exceeding current COR limitations.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include one or more stiffening elements or other structures engaging the face to provide locally increased stiffness to particular areas of the face. The stiffening element is movable to create targeted regions of increased stiffness (e.g., in the upper heel and/or lower toe quadrants) in desired locations, which leaves other, targeted regions of the face to have increased flexibility as compared to the stiffened regions. By locating the targeted regions of increased face flexibility at locations on a face where a golfer tends to hit the ball, the golf shot may experience increased "kick" off the face on off-center hits (provided the off-center hits impact the face at the locations of increased flexibility and at a sufficient velocity), e.g., due to the increased COR response and a trampoline-like effect at these off-center locations. While increasing the COR response at some targeted off-center locations, the regions of increased stiffness may be used to control the overall club head's COR response and to assure that the COR of the club head remains within the constraints of the Rules of Golf.

According to one aspect, the stiffening element is moveable and engages a contact point on an inner surface of the face, which can provide locally increased stiffness to the areas of the face proximate the contact point. Movement of the stiffening element changes the contact point on the inner surface, which also changes the area of locally increased stiffness.

According to another aspect of the invention, the movable stiffening element is rotatably affixed to the face, and the stiffening element is configured for rotational movement. The movable stiffening element may include a pivot member affixed to the inner surface of the face, with an arm extending from the pivot member and being movable by rotating about the pivot member.

According to another aspect of the invention, the movable stiffening element engages a plurality of contact points on the inner surface of the face, and movement of the stiffening element changes at least one of the plurality of contact points. In one embodiment, the movable stiffening element has a plurality of arms spaced from the inner surface of the face. Each arm has an engaging member extending therefrom to engage one of the plurality of contact points on the inner surface of the face, and movement of the stiffening element changes at least one of the plurality of contact points. The arms of the stiffening element can be arranged in an X-shape, a Y-shape, or any other shape.

According to still another aspect of the invention, at least a portion of the body is removable to provide access to the movable stiffening element. In one example, the head is formed of a face member having a cup face structure, including the face and a wall extending rearward from the face, and a backbody member connected to the wall of the face member. The backbody member and at least a portion of the wall of the face member define the body. The backbody member may be removable to provide access to the movable stiffening element.

Other aspects of this invention relate to face members for use in a ball striking device, including a face, a wall extending rearward from an outer periphery of the face, and a moveable stiffening element coupled to the face. The face has an outer surface configured for striking a ball and an inner surface located rearward and opposite of the outer surface. The moveable stiffening element engages a contact point on an inner surface of the face to provide increased stiffness to an area of the face proximate the contact point. Movement of the stiffening element changes the contact point on the inner surface, which also moves the area of increased stiffness.

Further aspects of the invention relate to methods that can be used for customizing or adjusting a golf club head, which is provided with a face configured for striking a ball with an outer surface thereof, a body connected to the face, and a moveable stiffening element connected to the face and engaging a contact point on an inner surface of the face to provide increased stiffness to an area of the face proximate the contact point. The method includes moving the stiffening element to change the contact point on the inner surface, which moves the area of increased stiffness.

According to one aspect, the stiffening element is adapted for engagement by a tool, and moving the stiffening element includes moving the stiffening element using the tool.

According to another aspect, a portion of the body is removable to provide access to the movable stiffening element. The method further includes removing the portion of the body prior to moving the stiffening element, and reconnecting the portion of the body subsequent to moving the stiffening element.

According to a further aspect, the head includes a cup face member including the face and a wall extending rearward from the face and a backbody member connected to the wall of the cup face member. The backbody member and at least a portion of the wall of the cup face member define the body, and the backbody member is removable to provide access to the movable stiffening element. In one example, the method further includes removing the backbody member prior to moving the stiffening element, and reconnecting the backbody member subsequent to moving the stiffening element.

Further aspects of the invention relate to a system that includes a golf club head as described above, a plurality of different backbody members, and a plurality of different gaskets. Each backbody member is configured to be connected to the wall of the cup face member, and each gasket is configured to be positioned between one or more of the backbody members and the wall of the cup face member when the respective backbody member is connected to the cup face member. Each of the backbody members and each of the gasket members are removable and interchangeable after connection to the cup face member.

Still further aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
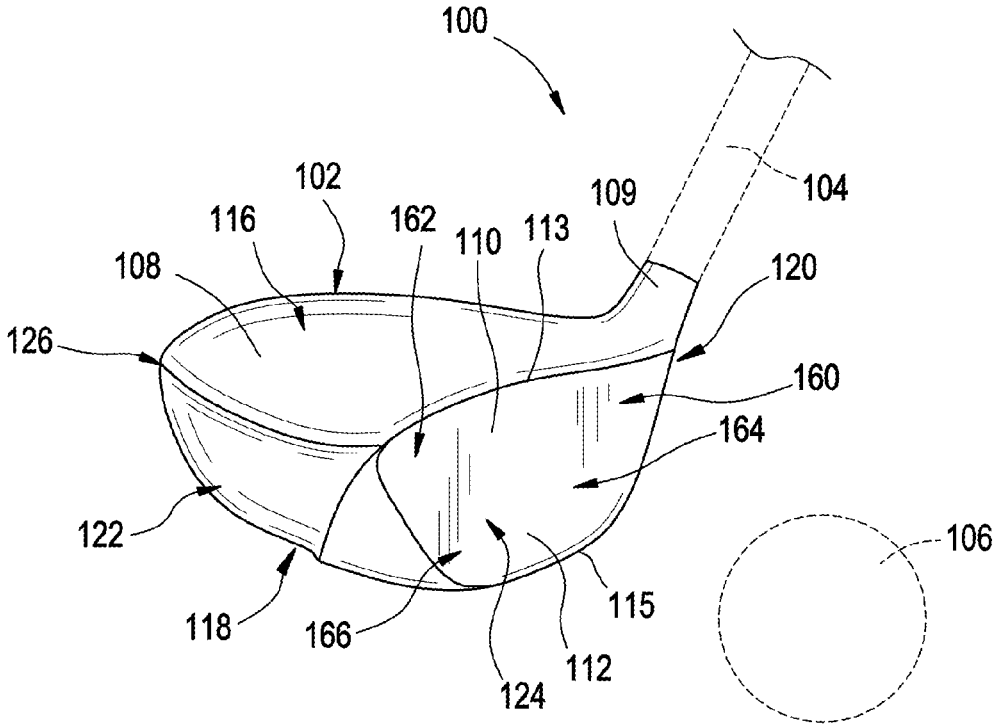
FIG. 1 is a perspective view of an illustrative embodiment of a head of a ball striking device according to the present invention, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Transverse" is not limited to perpendicular or generally perpendicular intersections, and refers broadly to any obliquely angled intersection.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including drivers, fairway woods, wood-type hybrid clubs, and the like, although aspects of this invention also may be practiced on irons, iron-type hybrid clubs, and the like.

According to various aspects of this invention, the ball striking device may be formed of one or more of a variety of materials, such as metals (including metal alloys), ceramics, polymers, composites, fiber-reinforced composites, and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers. Such devices may include a one-piece construction or a multiple-piece construction. An example structure of ball striking devices according to this invention will be described in detail below in conjunction with FIG. 1, and will be referred to generally using reference numeral "100."

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. A ball 106 in use is also schematically shown in FIG. 1, in a position to be struck by the ball striking device 100.

The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

Figure 2:
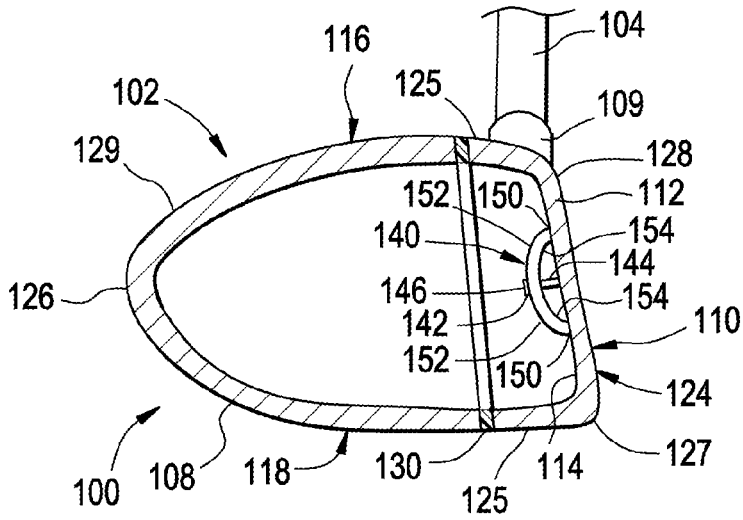
FIG. 2 is a cross-section view of the head of FIG. 1.
Figure 3:
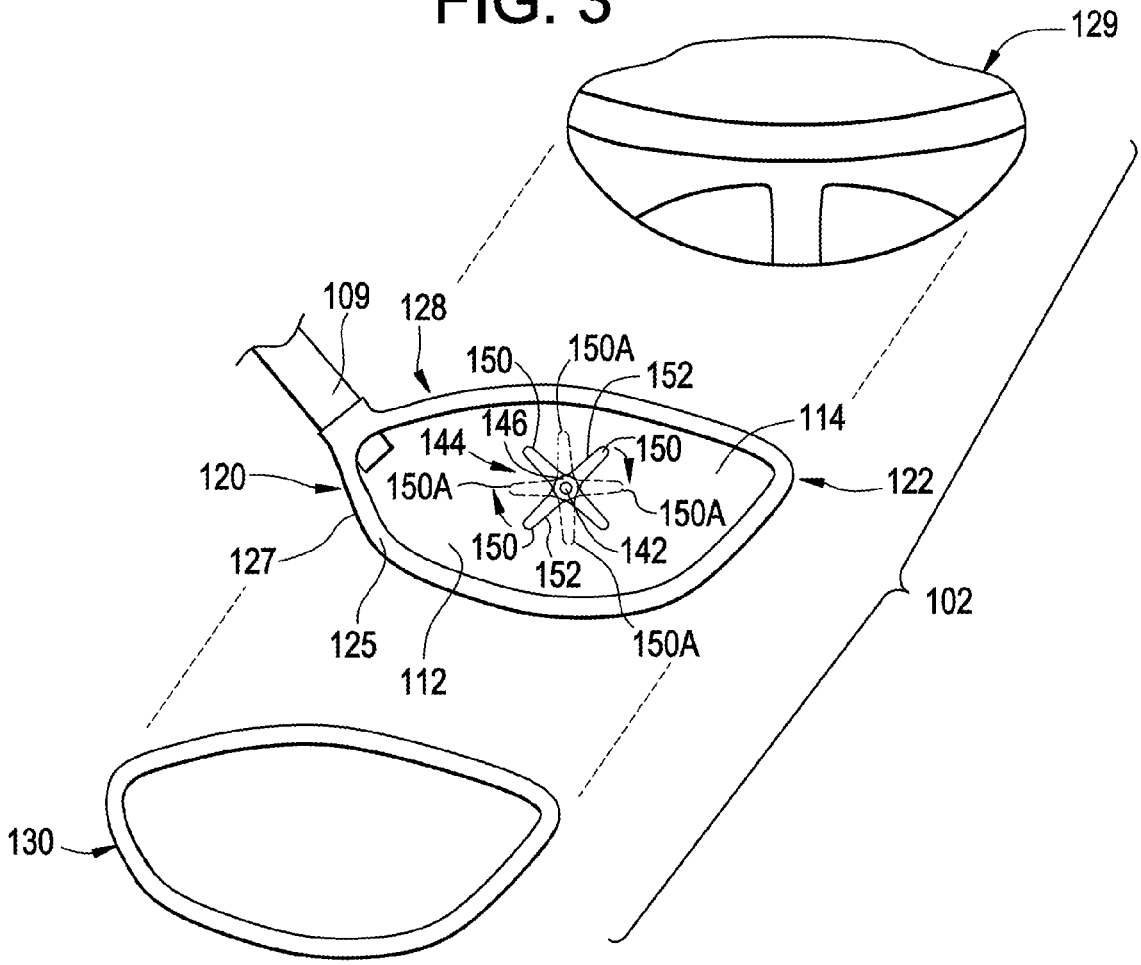
FIG. 3 is an exploded rear view of the head of FIG. 1, with a portion of the head broken away to show detail.

In the illustrative embodiment illustrated in FIGS. 1-3, the head 102 has a hollow structure defining an inner cavity (e.g., defined by the face 112 and the body 108). Thus, the head 102 has a plurality of inner surfaces defined therein. In one embodiment, the hollow center cavity may be filled with air. However, in other embodiments, the head 102 could be filled with another material, such as a foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon. The ball striking surface 110 is configured to face a ball 106 in use, and is adapted to strike the ball 106 when the device 100 is set in motion, such as by swinging. As shown, the ball striking surface 110 is relatively flat, occupying most of the face 112. For reference purposes, the portion of the face 112 near the top face edge 113 and the heel 120 of the head 102 is referred to as the "high-heel area" 160; the portion of the face 112 near the top face edge 113 and toe 122 of the head 102 is referred to as the "high-toe area" 162; the portion of the face 112 near the bottom face edge 115 and heel 120 of the head 102 is referred to as the "low-heel area" 164; and the portion of the face 112 near the bottom face edge 115 and toe 122 of the head 102 is referred to as the "low-toe area" 166. Conceptually, these areas 160-166 may be recognized as quadrants of substantially equal size (and/or quadrants extending from a geometrical center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. In one embodiment, the face 112 is formed as part of a face frame member 128, such as shown in FIG. 2, with a wall or walls 125 extending rearward from the edges 127 of the face 112. This configuration is also known as a cup face structure. The body 108 can be formed as a separate piece or pieces joined to the walls 125 of the face frame member 128. In the illustrative embodiment shown in FIG. 2, the body 108 is partially formed by a backbody member 129, which may be a single piece or multiple pieces. The walls 125 of the face frame member 128 combine with the backbody member 129 to form the body 108 of the head 102. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member 128. Further, a gasket 130 may be included between the face frame member 128 and the backbody member 129, as shown in FIG. 2. The gasket 130 may be a polymeric material (e.g., rubber, polytetrafluoroethylene, or other material) or other material disposed between the face frame member 128 and the backbody member 129.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has one or more movable stiffening elements connected to the face 112, for providing increased stiffness to certain areas or portions of the face 112. Generally, the stiffening element engages one or more contact points on the inner surface 114 of the face 112, and provides increased stiffness at and/or around the contact point(s), such as by exerting a force on the inner surface 114 of the face 112. Additionally, the stiffening element is movable, and movement of the stiffening element changes the location of the contact point. By changing the contact point, the head 102 can be adjusted so that desired areas of the face 112 have locally increased stiffness, to control the locations of one or more targeted regions of increased face flexibility, as described above.

Figure 4:
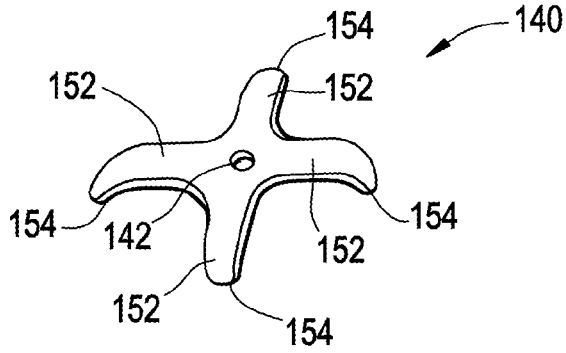
FIG. 4 is a perspective view of a stiffening element of the head of FIGS. 1-3.

FIGS. 2-4 illustrate one illustrative embodiment of a stiffening element 140, which is rotatably connected to the inner surface 114 of the face 112. In this embodiment, the stiffening element 140 is connected to the inner surface of the face 112 by a pivot member 144 attached to the inner surface 114 of the face 112. The pivot member 144 is fixedly attached to the inner surface 114 of the face 112, and the stiffening element is rotatably connected to the pivot member 144. In the illustrative embodiment shown, the pivot member 144 is a threaded pin 144, and the stiffening element 140 is freely rotatable about the pivot member 144. As illustrated in FIGS. 2-4, the pivot member 144 defines a pivot point 142 for the stiffening element 140, and the stiffening element 140 is able to rotate about the pivot point 142. A threaded retainer, such as a nut 146, is threaded onto the end of the pivot member 144 to retain the stiffening element 140 on the pivot member 144.

The nut 146 can be loosened to permit rotation of the stiffening element 140, and can then be tightened to hold the stiffening element 140 in position. Accordingly, the nut 146 can function both as a retainer and as an element for locking and unlocking the stiffening element 140 for rotation. In other embodiments, a different type of retaining structure and/or locking/unlocking structure can be incorporated into the head 102. The nut 146 can also be adjusted to cause the stiffening element 140 to apply greater or lesser pressure to the inner surface 114 of the face 112.

In the embodiment shown in FIGS. 2-4, the stiffening element 140 is not accessible from outside the head 102, and a portion of the head 102 can be opened or removed in order to access the stiffening element 140. For example, the back-body member 129 may be removable, as described below, or the head 102 may have an opening therein that has a cap, closure, door, etc. that is removable (such as by snapping or threading) to permit access to the stiffening element 140. Additionally, the stiffening element 140, the pivot member 144, and/or the nut 146 may be configured for engagement by a tool (such as a screwdriver, Allen wrench, socket wrench, etc.) for causing rotation of the stiffening element 140 and/or the pivot member 144. It is understood that fixed and movable connections described in this embodiment can be made using any connections known and used in the art, including through the use of various fasteners, adhesives, binders, etc. In another illustrative embodiment, the stiffening element 140 may contain a threaded bore for connection to the threaded pin 144, and the nut 146 may or may not be included. In a further illustrative embodiment, the pivot member 144 may be rotatably connected to the face 112 to permit rotation of the pivot member 144 and stiffening element 140, thereby rotating and/or tightening the stiffening element 140. In this embodiment, the rotatable pivot member 144 may be accessible from outside the head 102 to rotate the pivot member 144, such as by direct access (e.g., through the face) or by an adjustment member 148 as described below. In further illustrative embodiments, the pivot member 144 may not be threaded, or the stiffening element 140 may be rotatably connected to the face 112 in another manner.

Figure 5:
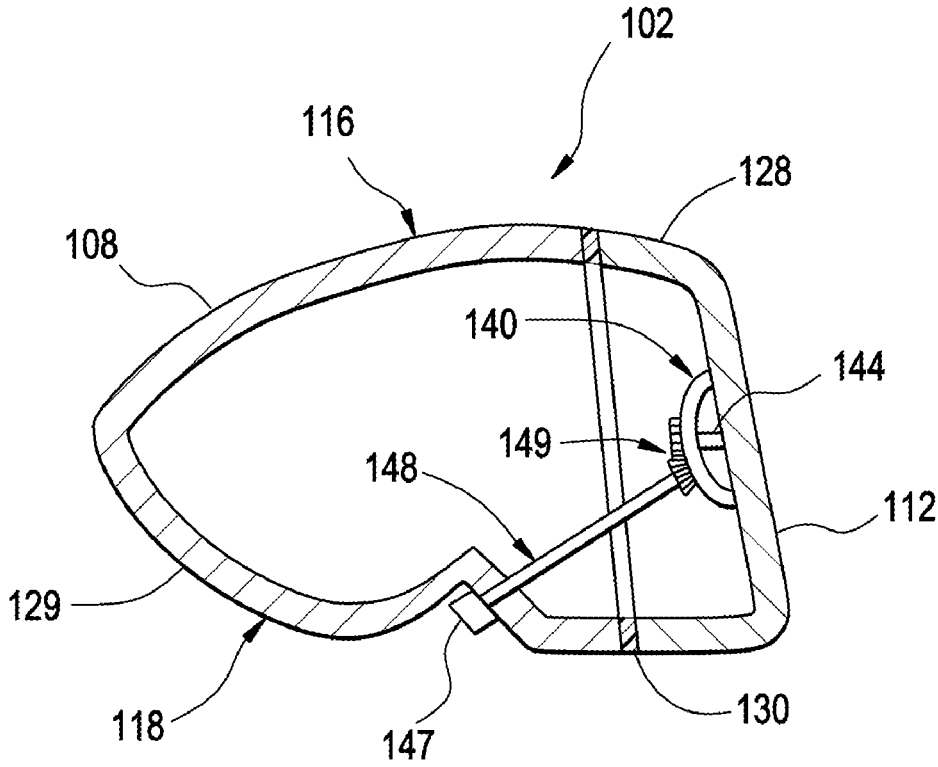
FIG. 5 is a cross-section view of another illustrative embodiment of a head of a ball striking device according to the present invention.

In alternate embodiments, the stiffening element 140 may be accessible or otherwise adjustable from outside the head 102. One such embodiment is illustrated in FIG. 5, where the head 102 includes an externally accessible adjustment member 148 that is operably connected to the stiffening element 140. Rotation of the adjustment member 148 causes rotation of the stiffening element 140. The adjustment member 148 extends to the bottom side 118 of the head 102, and is accessible through the bottom 118. In the embodiment shown, the adjustment member 148 and the stiffening element 140 have a complementary gear teeth connection 149 to permit rotation of the stiffening element 140 by the adjustment member 148. The adjustment member 148 has an end 147 which may be adapted for engagement by a tool for manipulation of the adjustment member 148. Other types of cooperative rotational means and structures may be used to connect the adjustment member 148 to the stiffening element 140, such as a universal joint, a worm gear, and other such structure. Additionally, a locking and/or retaining structure may be incorporated into the head 102, such as the nut 146 described above, which can be manipulated to unlock the stiffening element 140 to permit rotation, and then to lock the stiffening element 140 once the desired position is reached. In another embodiment, the adjustment member 148 may be accessible through a different surface, such as the top side 116 or the rear 126 of the head 102, rather than the bottom side 118, and in still another embodiment, an adjustment member may be accessible through the face 112. In additional alternate embodiments, the adjustment member 148 may be operably connected to the pivot member 144 to cause rotation of the pivot member 144. In a further embodiment, the adjustment member 148 may be coaxial with the pivot member 144 and/or the stiffening element 140, such as by extending to the back 126 of the body 108.

Figure 5A:
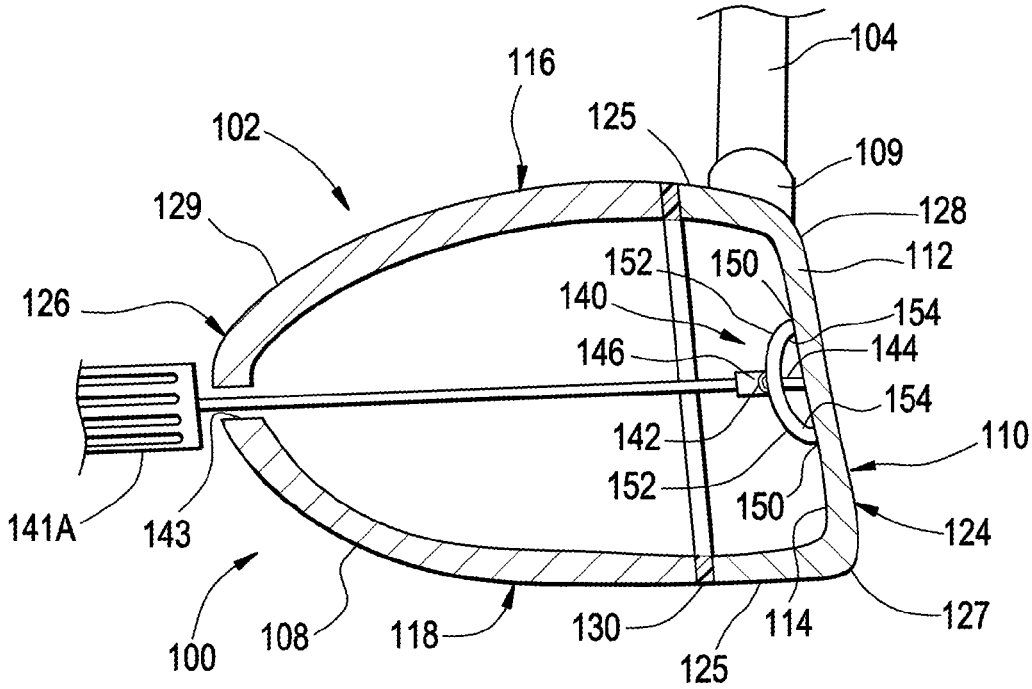
FIG. 5A is a cross-section view of a further illustrative embodiment of a head of a ball striking device according to the present invention, shown with a first tool for adjusting a stiffening element of the head.
Figure 5B:
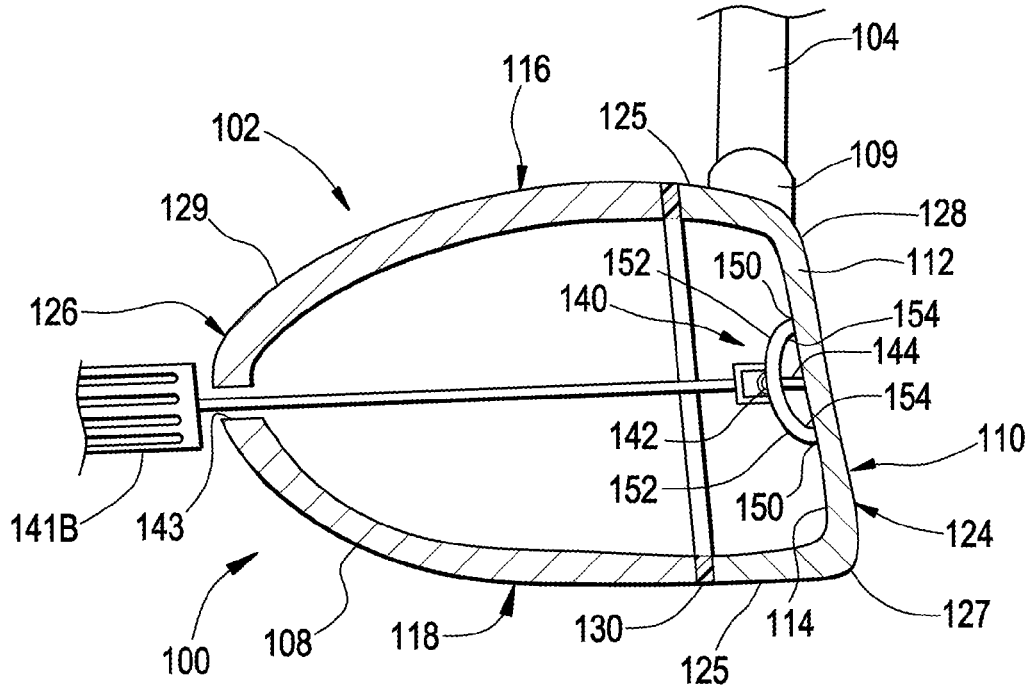
FIG. 5B is a cross-section view of the head of FIG. 5A, shown with a second tool for adjusting the stiffening element of the head.

In an alternate embodiment, one or more specialized tools may be provided to access the stiffening element 140 and/or a retaining/locking structure (e.g., the nut 146) from outside the head 102, for manipulation of the stiffening element 140. The head 102 may be configured to permit access by the tool(s) through the exterior, such as by including an aperture in the face 112 and/or the body 108. For example, the tool may be a long-insertion tool that could be used through an aperture in the body 108. As described above, the head 102 may include a locking and/or retaining element (e.g., the nut 146), and it is understood that separate tools may be provided for separately manipulating the locking/retaining element and the stiffening element 140, and that this separate manipulation may be done in a sequential or simultaneous manner. For example, a stiffening element and a locking/retaining element may be concentrically moveable, such as shown in FIGS. 2 and 3, where the stiffening element 140 and the nut 146 are concentrically rotatable, and one or more tools can be provided to sequentially manipulate the stiffening element 140 and the nut 146 through the same aperture in the body 108. In one illustrative embodiment, shown in FIGS. 5A and 5B, the stiffening element 140 and the nut 146 are each specially adapted for engagement by separate tools 141A, 141B, such as in a variety of manners known in the art. The tools 141A, 141B may be sequentially inserted through the same aperture 143 in the face 112 or body 108 to manipulate the stiffening element 140 and the nut 146. As shown in FIG. 5A, the first tool 141A is inserted through the aperture 143 to loosen the nut 146, and then the second tool 141B is inserted through the aperture 143 to adjust the stiffening element 140. The first tool 141A may then be re-inserted to tighten the nut 146 again. It is understood that a plug, door, insert, etc., may be provided to close the aperture 143 when not in use. In other embodiments, where the stiffening element is differently configured, a different type of tool may be provided.

The stiffening element 140 shown in FIGS. 2-4 has four contact points 150 between the stiffening element 140 and the inner surface 114 of the face 112 to create four areas of locally increased stiffness on the face 112. In this embodiment, the stiffening element 140 has four arms 152 extending from the pivot point 142 in an approximate X-shape. Each of the arms 152 of the illustrated stiffening element 140 is spaced from the inner surface 114 of the face 112, and each arm 152 has an engaging member 154 at its distal end. The engaging members 154 engage the inner surface 114 of the face 112 to form the contact points 150 and to exert force on the contact points 150. In this embodiment, the engaging members 154 are a continuous and integral portion of their respective arm 152. However, in another embodiment, the engaging member 154 may be more clearly defined in contrast from the respective arm 152 (such as in FIGS. 6-8), and may be located elsewhere on the stiffening element 140. As shown in FIG. 3, the stiffening element 140 can be rotated to change the contact points 150 to new locations 150A. The contact points 150 in FIG. 3 position the areas of locally increased stiffness so that the high-center, low-center, mid-heel, and mid-toe regions of the face 112 have relatively increased flexibility. Rotation of the stiffening element 140 to position the contact points to locations 150A changes the positions of the areas of locally increased stiffness so that the high-heel, high-toe, low-heel, and low-toe areas of the face 112 have relatively increased flexibility. In the illustrative embodiment shown in FIGS. 2-4, the rotation of the stiffening element 140 changes all of the contact points 150 simultaneously; however, in other embodiments, the stiffening element 140 may be configured to change fewer than all of the contact points 150, or to selectively change specified contact points 150.

FIGS. 6-9 illustrate other illustrative embodiments of rotatable stiffening elements 240, 340, 440, 540 which are similar in some respects to the stiffening element 140 described above and shown in FIGS. 2-4. The stiffening element 240 shown in FIG. 6 has four arms 152 extending from a pivot point 142 in an approximate X-shape, with each arm 152 having an engaging member 154 at its distal end. The stiffening element 240 is connectable to the face 112 in a similar manner as described above, through the use of a pin similar to the pin 144 as illustrated in FIGS. 2 and 3. The stiffening element 240 has slight structural differences from the stiffening element 140 shown in FIGS. 2-4. For example, the stiffening element 240 has engaging members 154 that are substantially perpendicular to the arms 152 from which they extend.

Figure 6:
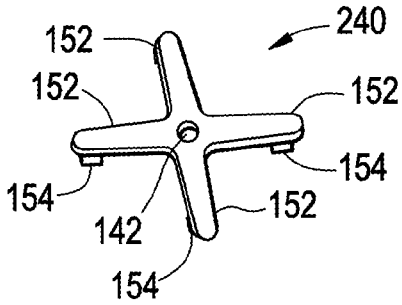
FIG. 6 is a perspective view of a second illustrative embodiment of a stiffening element according to the present invention.
Figure 7:
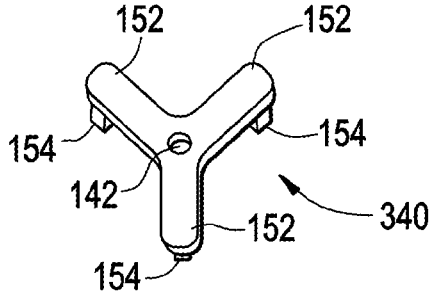
FIG. 7 is a perspective view of a third illustrative embodiment of a stiffening element according to the present invention.
Figure 8:
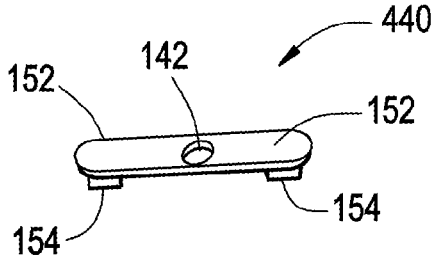
FIG. 8 is a perspective view of a fourth illustrative embodiment of a stiffening element according to the present invention.

The stiffening element 340 shown in FIG. 7 and the stiffening element 440 shown in FIG. 8 are similar to the stiffening element 240 shown in FIG. 6, with some structural differences. For example, the stiffening element 340 in FIG. 7 has three arms 152 extending from the pivot point 142 to form an approximate Y-shape, rather than the X-shaped configuration described above. Similarly, the stiffening element 440 of FIG. 8 has two arms 152 extending from the pivot point 142 in a relatively straight line. The arms 152 of the stiffening element 340 in FIG. 7 and the stiffening element 440 in FIG. 8 are structured similarly to those of the stiffening element 240 of FIG. 6, with the arms 152 having engaging members 154 that are substantially perpendicular to the arms 152.

Figure 9:
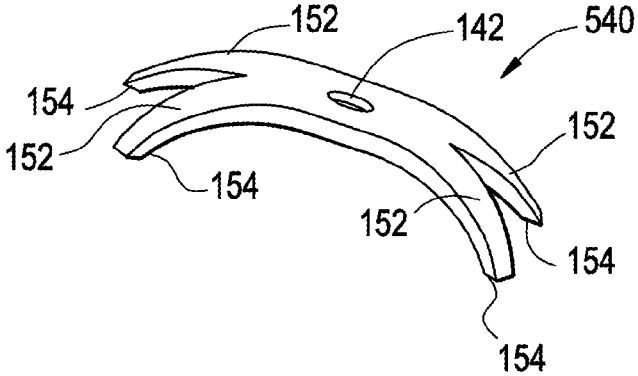
FIG. 9 is a perspective view of a fifth illustrative embodiment of a stiffening element according to the present invention.

The stiffening element 540 shown in FIG. 9 is similar in many ways to the stiffening element 140 described above. The stiffening element 540 has four arms 152 that extend from a central pivot point 142 in an approximate X-shape. Also, the stiffening element 540 is configured for connection to the inner surface 114 of the face 112 using the pin 144 and nut 146 described above. One difference between the stiffening element 540 shown in FIG. 9 and the stiffening element 140 described above is the shape thereof. The stiffening element 540 in FIG. 9 has a much tighter and more elongated X-shape, which creates a different distribution of areas with locally increased stiffness and resultant areas of relatively increased flexibility than the stiffening element 140 shown in FIGS. 2-4.

Each of the illustrated stiffening elements 140, 240, 340, 440, 540 includes engaging members 154 at the tips of arms 152 on the stiffening elements 140, 240, 340, 440, 540. However, it is understood that other configurations are possible. For example, the stiffening elements may not have identifiable arms, and larger portions of the stiffening element may contact the inner surface 114 of the face 112. As another example, the engaging members may not be located at the tips of the arms, and/or each arm may have more than one engaging member. Other differences and similarities between the illustrated stiffening elements 140, 240, 340, 440, 540 are apparent to those skilled in the art. Further, in other embodiments, the stiffening elements 140, 240, 340, 440, 540 may be constructed differently, such as by connecting differently to the face or by changing the number and/or configuration of the arms 152. For example, the stiffening element may have a T-shape, a V-shape, a C-shape, an I-shape, or any other shape as desired.

In further embodiments, the head 102 may contain a rotatable stiffening element that has less similarity to the stiffening elements 140, 240, 340, 440, 540 described above. As one example, a rotatable stiffening element may be rotationally asymmetrical, such as by positioning the pivot point 142 at the tip of one of the arms of an X-shaped stiffening element. In other embodiments, as described above, the stiffening element may be rotatably connected to the face in another manner, using a different structure. As some examples, the face 112 and the stiffening element may be connected by a tongue-and-groove connection, a clamping arrangement, or an interference fit, all of which may allow rotation of the stiffening element. Still other configurations of rotatable stiffening elements are possible.

In other illustrative embodiments, the head 102 may contain a movable stiffening element that is not rotatable, and which moved in a different manner. For example, the stiffening element may move in a sliding motion, an orbiting motion, a rolling motion, or any other motion. It is understood that the stiffening element and the face 112 may be complementarily structured and configured for connection of the stiffening element to the face 112 in a manner which permits such motion. Still further, the head 102 may contain more than one movable stiffening element.

In further embodiments, the moveable stiffening element may not be connected to the face 112, and may simply engage the face 112 through one or more engaging members 154. For example, the stiffening element may be forced against the face by an operable connection with the body 108, such as a brace extending from an inner surface of the body 108 to push the stiffening element into engagement with the face 112. As another example, the stiffening element may be connected to an adjustment member, which may be similar to the adjustment member 148 shown in FIG. 5, which forces the stiffening element into engagement with the face 112. Various other types of rotatable or other moveable stiffening elements that can be mounted to engage the face 112 in various other configurations are considered to be within the scope of the present invention.

Various embodiments of the stiffening element are generally accessible for manipulation and adjustment, such as directly or indirectly by a user, a machine, or other device or entity. In one embodiment, a portion of the body 108 of the head 102 can be removed in order to provide access to a stiffening element that is contained inside the head 102. As described herein, removal of any portion of the body 108 additionally includes non-total or non-permanent removal. For example, opening a swinging or sliding door formed in the body 108 to provide access to the stiffening element constitutes removal of that portion, even though the portion is not completely removed. As another example, removal of a piece that can be reconnected later also constitutes removal. In another embodiment, an adjustment member that is accessible from outside the head, such as the adjustment member 148 described above and illustrated in FIG. 5, can be used for manipulating the stiffening element. In a further embodiment, the adjustment member may be accessible through the face or through a slot or opening in the head 102, and may be configured to be manipulated with an appropriate tool.

In the embodiment shown in FIG. 2, the backbody member 129 is removable in order to provide access to the stiffening element 140. Once the stiffening element 140 has been adjusted, the backbody member 129 can be reattached. Additionally, a plurality of different backbody members can be provided, all of which can be attached to the face frame member 128 in place of the backbody member 129 illustrated in FIG. 2. The ability to interchange backbody members 129 permits greater control over various features and properties of the club head, including weighting, weight distribution, aerodynamics, and others. Similarly, the gasket 130 may be removable and may also be interchangeable with other gaskets, such as to provide different properties or to match interchanged backbody members. It is contemplated that a kit or system can be provided that contains a face frame member 128 and a plurality of different backbody members 129 and/or gaskets 130 that are interchangeable.

Several different configurations for removable and/or interchangeable backbody members are shown and described in U.S. patent application Ser. No. 12/192,402, filed Aug. 15, 2008, which is incorporated by reference herein and made part hereof. For example, FIGS. 10-17 illustrate various embodiments of golf club heads 202, 302, 402, 502, each containing a face frame member with a cup face structure and a removable backbody member.

Figure 10:
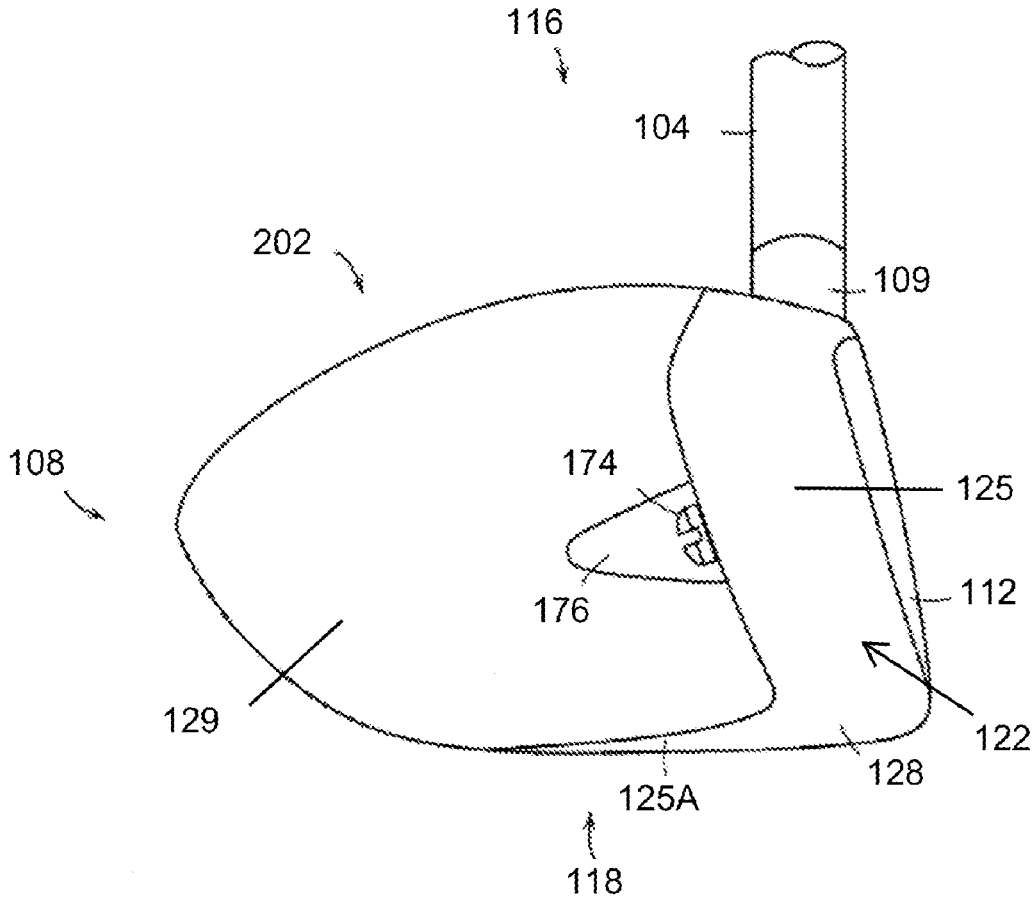
FIG. 10 is a side view of a second illustrative embodiment of a head of a ball striking device according to the present invention.
Figure 11:
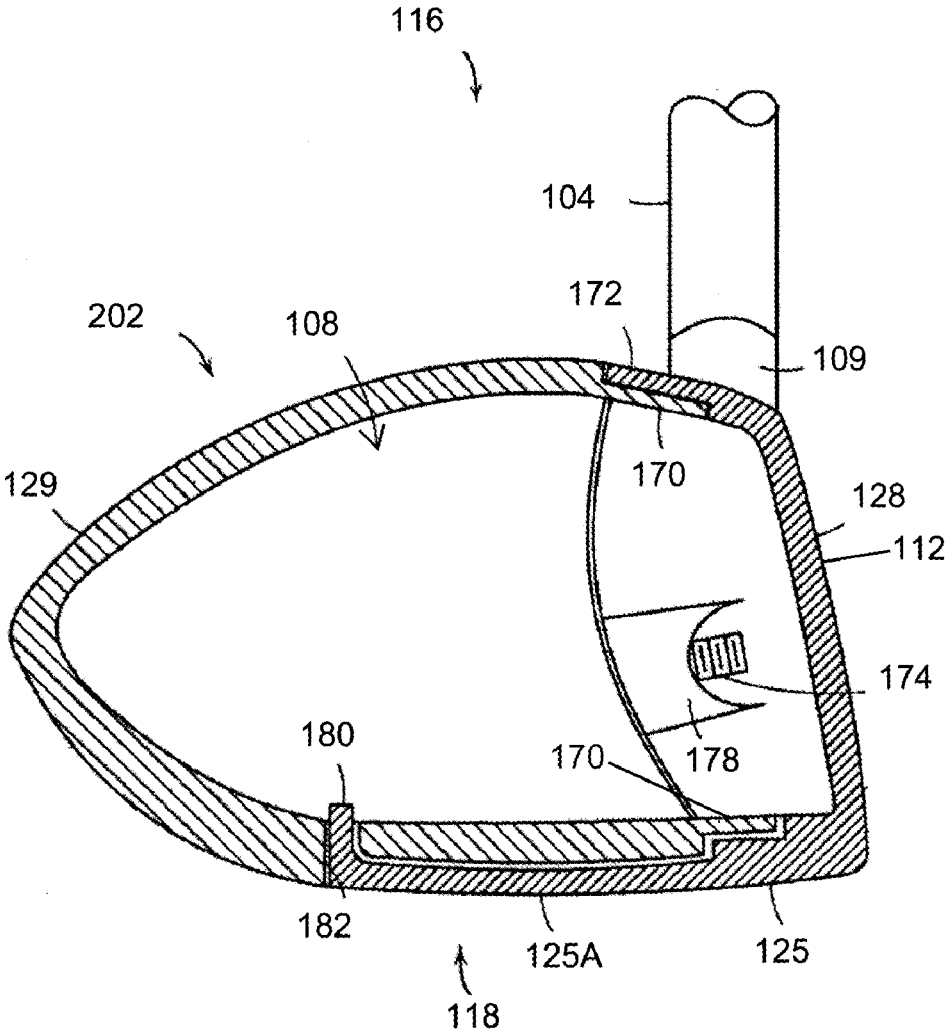
FIG. 11 is a cross-section view of the head of FIG. 10.

FIGS. 10-11 illustrate one such illustrative embodiment of a head 202, which contains many basic features similar to the head 102 described above. The head 202 is formed of a face frame member 128 with a cup face structure, having the face 112 and a wall or walls 125 extending rearward from the face 112, and a backbody member 129 connected to the face frame member 128. The walls 125 include an extended sole portion 125A on the sole 118 of the head 202.

The sole portion 125A projects from a lower edge of the face 112, thereby extending toward the rear portion 120 of the head 202. The sole portion 125A may extend all the way to the rear edge of the head 202. In one embodiment, the sole portion 125A extends more than halfway across the front-to-rear length of the head 202.

The backbody member 129 is removably attached to the face frame member 128. In one aspect and as embodied in FIGS. 10-11, the backbody member 129 is formed as a hollow body. As best shown in FIG. 11, the backbody member 129 includes an internal concavity at least partially enclosed by the walls thereof. The backbody member 129 further includes an opening that faces the face frame member 128. In the illustrated embodiment, the backbody member 129 includes a perimeter flange 170 for complementary insertion into a perimeter flange 172 on the wall(s) 125 of the face frame member 128. When the backbody member 129 is attached to the face frame member 128, a closed or substantially closed internal cavity is formed within the head 202. It is understood that the perimeter flange 170 of the backbody member 129 may overlay the perimeter member 172 of the face frame member 128. Optionally, if desired a gasket or other such material may be provided at the joint between the backbody member 129 and the face frame member 128 (e.g., fully or partially around the perimeter of the joint) to dampen noise or vibration, reduce rattling, provide sealing, etc.

In the illustrative embodiment of FIGS. 10-11, the backbody member 129 is removably and replaceably coupled to the face frame member 128 by threaded fasteners 174. In the embodiment shown in FIGS. 10-11, one threaded fastener 174 is located on the toe side 122 of the head 202 and the other threaded fastener 174 is located on the heel side 120. Each of these threaded fasteners has a longitudinal axis that is oriented approximately perpendicular to the plane of the face 112. The backbody member 129 includes countersunk portions 176 to allow for insertion and removal of the threaded fasteners 174 at the proper angle. As best shown in FIG. 11, in this particular embodiment, for each fastener, the face frame member 128 includes a boss 178 attached to or formed at an inner side wall. The end of the threaded portion of fastener 174 extends into and/or through the boss 178.

As described above, the face frame member 128 of the embodiment of FIGS. 10-11 includes the sole portion 125A. An elastically-deformable element couples the backbody member 129 to the sole portion 125A in this example structure. Specifically, the rearward-most end of the sole portion 125A includes a tab 180. The tab 180 is designed to slide into a slot 182 defined in the backbody member 129, thereby coupling the sole portion 125A to the bottom of the backbody member 129. The tab 180 is elastically deformable, thereby facilitating the insertion of the tab 180 into the complementary slot 182, and further providing a biasing of the backbody member 129 relative to the face frame member 128. Biasing may be used to remove unwanted play between the two detachably attached members. A person of ordinary skill in the art will appreciate that other fastening mechanisms may be used to detachably attach the sole portion 125A to the backbody member 129, given the benefit of this disclosure.

In an alternate embodiment (not shown), the sole portion 125A may include a through-hole at its rearward-most end, so that the sole portion 125A may be fastened to the backbody member 129 with a threaded fastener (e.g., threaded into a boss or an attached nut member included with the body member structure).

Figure 12:
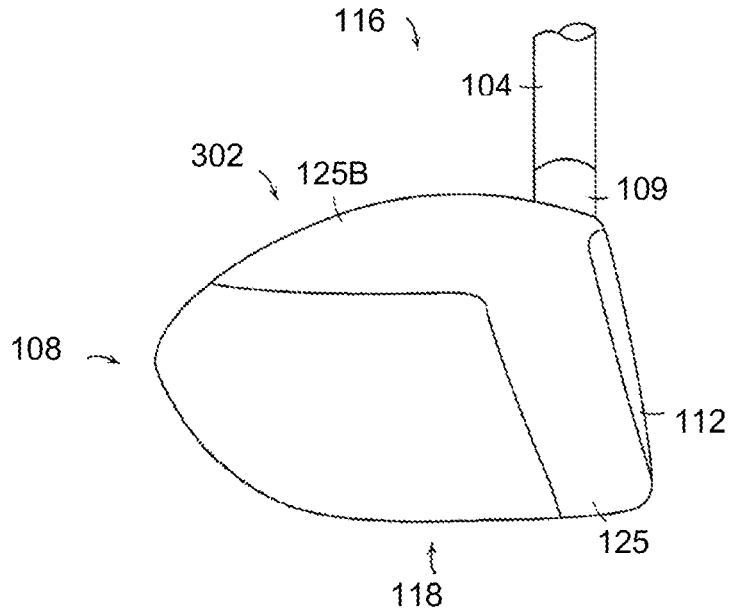
FIG. 12 is a side view of a third illustrative embodiment of a head of a ball striking device according to the present invention.
Figure 13:
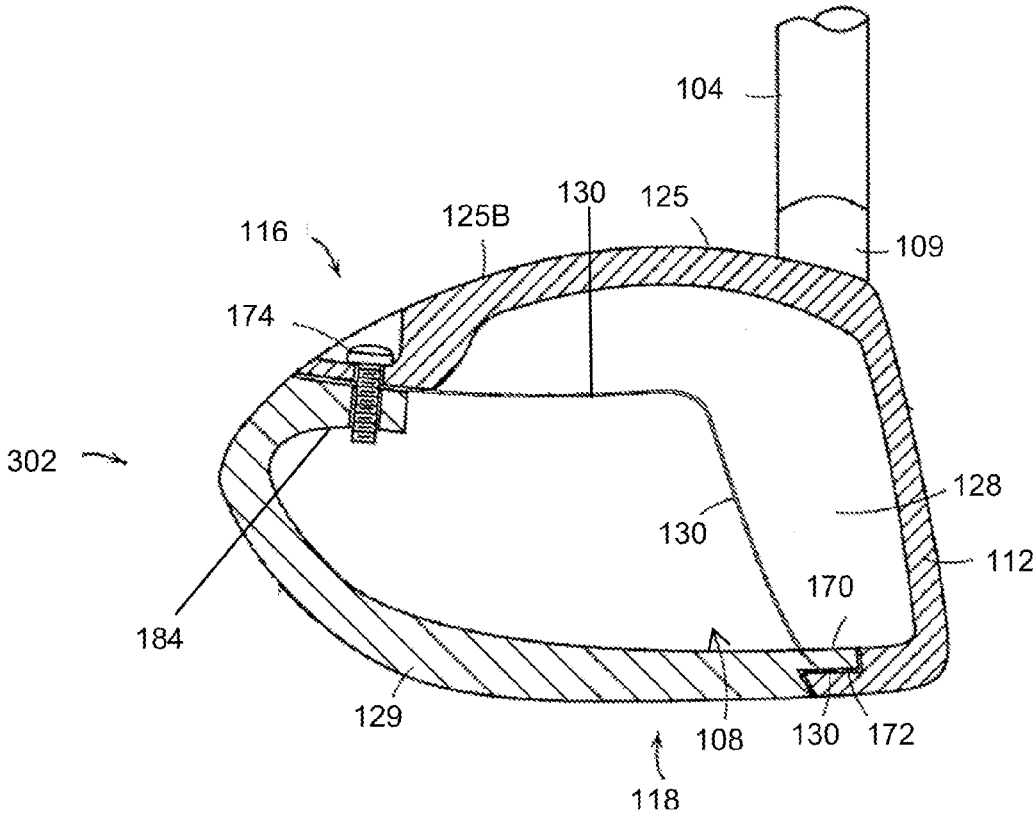
FIG. 13 is a cross-section view of the head of FIG. 12.

In the embodiment of the head 302 shown in FIGS. 12-13, the walls 125 of the face frame member 128 include a crown portion 125B adapted for connection to the backbody member 129. The crown portion 125B projects rearwardly from a top portion of the face 112. In this particular embodiment, the crown portion 125B is integrally formed with the face frame member 128. At the rearward-most end of the crown portion 125B, a threaded fastener 174 is provided to detachably attach the backbody member 129 to the face frame member 128. Additional fasteners may be provided at other locations, if desired.

The backbody member 129 may include an inner cavity partially enclosed by the walls thereof. The upper portion of a rear wall of the backbody member 129 extends inward and provides a platform 184 for receiving the threaded portion of fastener 174. At the bottom portion of the backbody member 129, a flange 170 overlaps a complementary flange 172 formed in the wall 125 of the face frame member 128. In this embodiment, a layer of removable, liquefiable adhesive 130 is located between the two flanges 170, 172, to function as a gasket. Further, the layer of removable, liquefiable adhesive 130 extends up and around the side walls and crown portion of the face frame member 128 where it interfaces with the backbody member 129. To detach the backbody member 129 from the face frame member 128, the fastener 174 is removed and then the removable adhesive is heated until it melts. Upon liquefaction of the adhesive, the backbody member 129 is debonded from the face frame member 128 such that the backbody member 129 easily slides apart from the face frame member 128. It is understood that the members 128, 129 can be connected without the adhesive, or with a different type of gasket in place of the adhesive.

Figure 14:
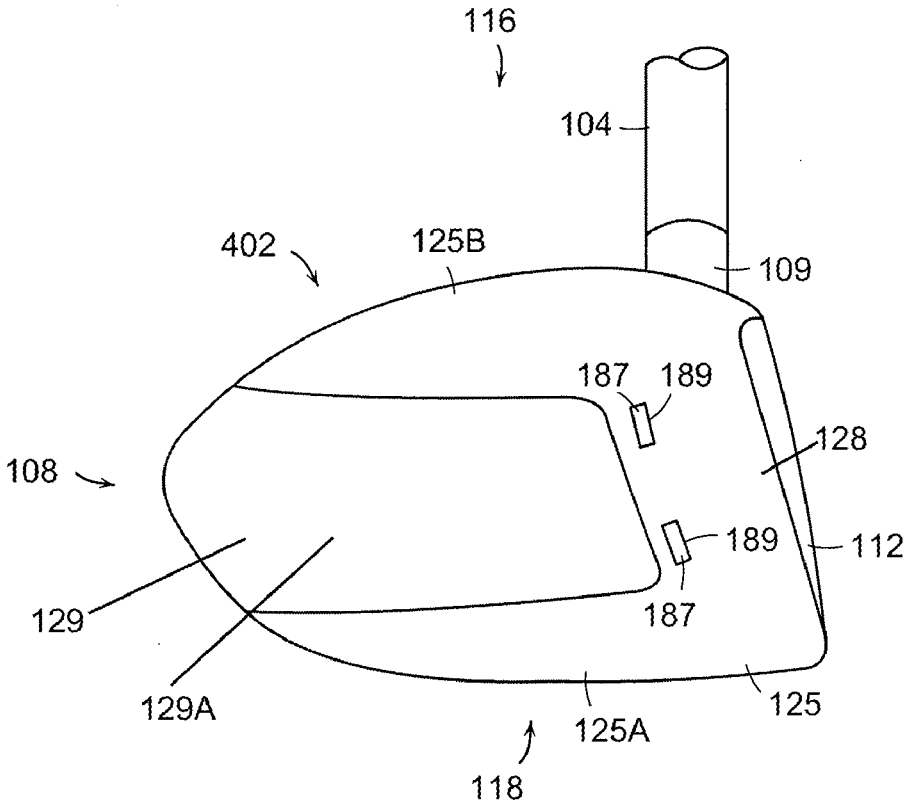
FIG. 14 is a side view of a fourth illustrative embodiment of a head of a ball striking device according to the present invention.
Figure 15:
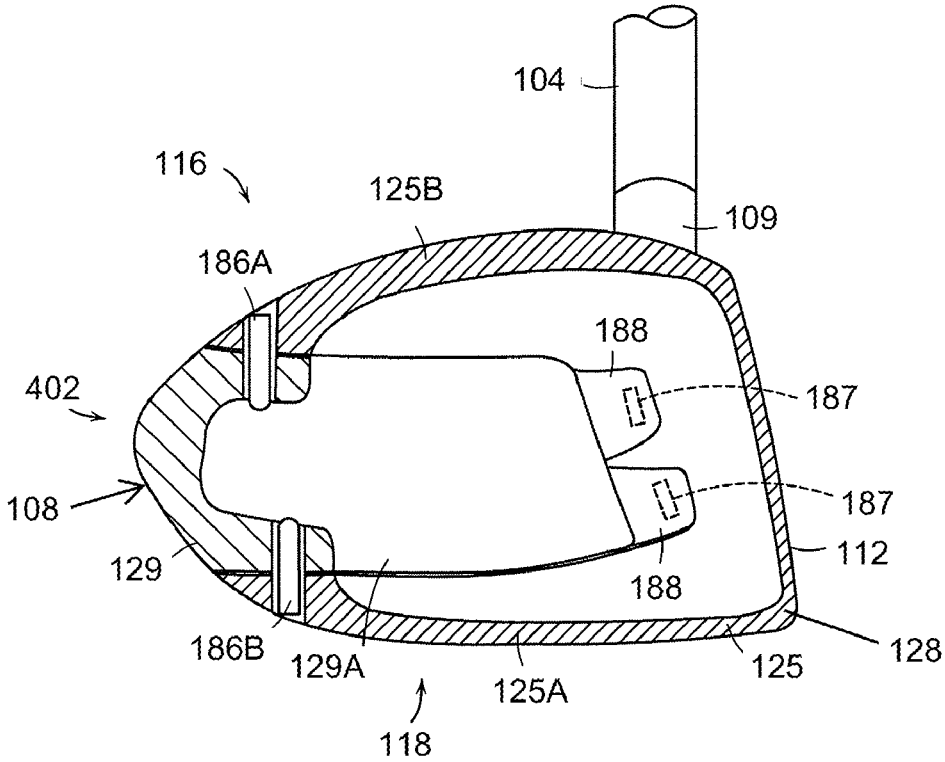
FIG. 15 is a cross-section view of the head of FIG. 14.

In the embodiment of the head 402 shown in FIGS. 14-15, the face frame member 128 has a cup face structure including the face 112 and walls 125 extending rearward from the face 112. The walls 125 include a crown portion 125B and a sole portion 125A. The backbody member 129 includes a concavity partially enclosed by the walls thereof. In this embodiment, the walls form a roughly U-shaped enclosure of the concavity, with two side walls 129A extending forwardly from a rear wall portion. The crown portion 125B projects rearwardly from a top portion of the face 112. The sole portion 125A projects rearwardly from a bottom portion of the face 112. In this particular embodiment, both the crown portion 125B and the sole portion 125A are integrally formed with the face frame member 128.

As best shown in FIG. 15, at the rearward-most end of the crown portion 125B, a through-hole is provided to accept a portion of a first pin 186*a*. A corresponding through-hole for accepting a different portion of the first pin 186*a* is provided in a top, rear portion of the backbody member 129. At the rearward-most end of the sole portion 125A, a through-hole is provided to accept a portion of a second pin 186*b*. A corresponding through hole for accepting a different portion of the second pin 186*b* is provided in a bottom, rear portion of the backbody member 129. The pins 186*a*, 186*b* removably attach the rear portion of the backbody member 129 to the rear portions of the face frame member 128 (i.e., the rear portion of the crown portion 125B and the rear portion of the sole portion 125A). In this particular embodiment, the pins 186*a*, 186*b* are elastically-deformable roll or spring pins. Optionally, in another embodiment, the pins 186*a*, 186*b* may include a plastically-deformable sleeve and a central (essentially) non-deformable pin.

At the forward-most ends of the side walls 129A of the backbody member 129, a pair of tabs 188 is provided in this particular embodiment. The tabs 188 may be formed of the same material as the rest of the backbody member 129, and further, may be formed integrally with the backbody member 129. In the attached configuration, the tabs 188 lie alongside the inner surface of a side wall of the face frame member 128. Each tab 188 includes a projection 187 that extends outwardly toward the side wall of the face frame member 128 and engages an aperture 189 of the face frame member 128. FIG. 15 shows a dashed outline of the projections 187, as they are located on the opposite side of the tabs 188 in this view.

To detach the backbody member 129 from the face frame member 128, the pins 186*a*, 186*b* are driven into the cavity, such as with a pin driver. Then, the projections 187 are disengaged from the apertures 189 by either using a tool to push the projections 187 inward or by squeezing the side walls 129A of the backbody member 129 toward one another. Of course, if desired, the various club head components illustrated in FIGS. 14-15 may be connected using other types of connectors, such as the threaded mechanical connectors described above.

It is to be appreciated that any number of fastening elements can be provided on the golf club head and that the location and orientation of the fastening elements described herein are merely illustrative. Other suitable methods for detachably attaching the backbody member 129 to the face frame member 128 will be apparent to persons of ordinary skill in the art, given the benefit of this disclosure.

Figure 16:
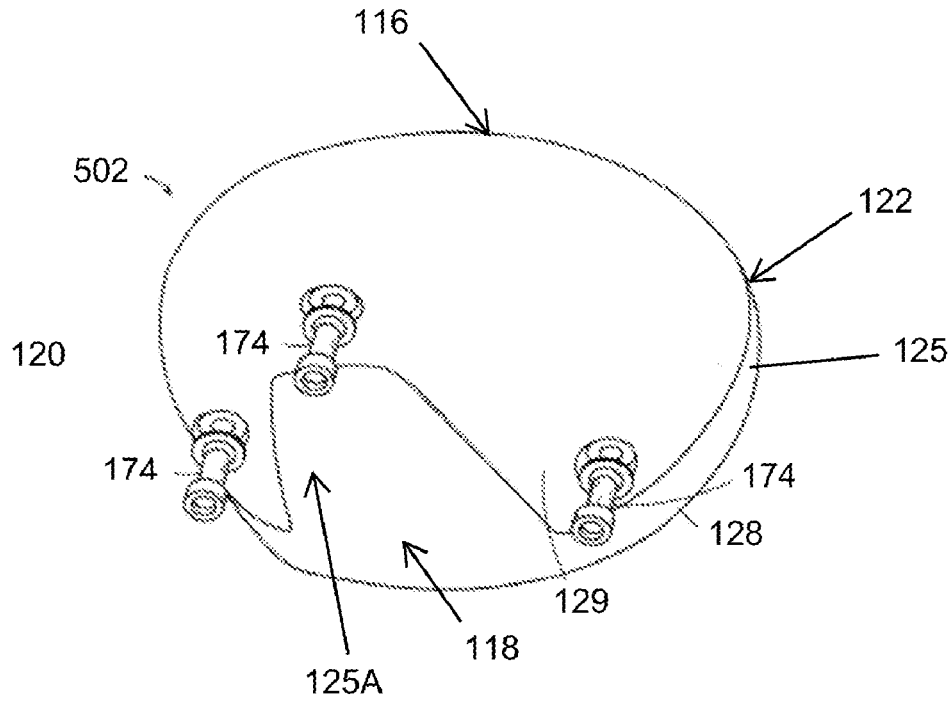
FIG. 16 is a side view of a fifth illustrative embodiment of a head of a ball striking device according to the present invention.
Figure 17:
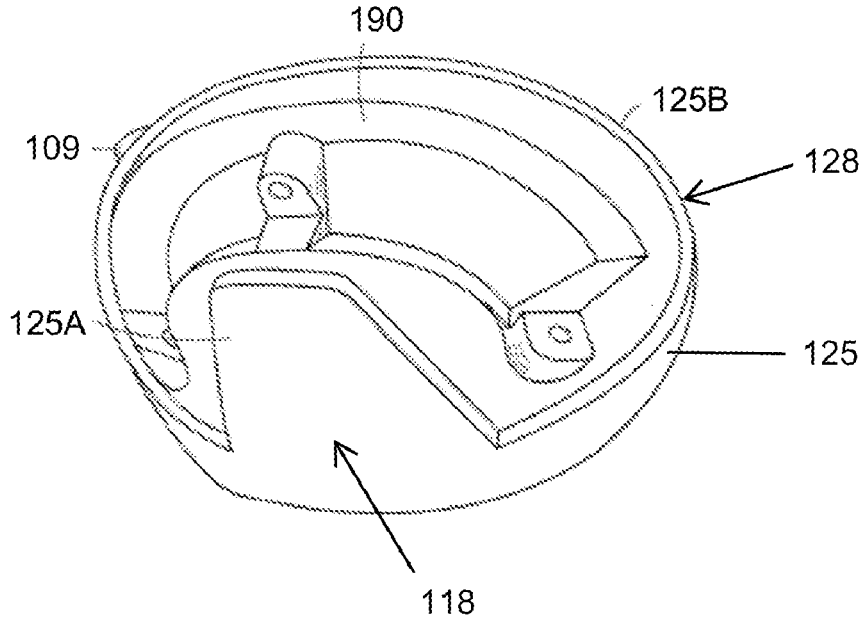
FIG. 17 is a cross-section view of the head of FIG. 16.

In an embodiment of the head 502 shown in FIGS. 16-17, the face frame member 128 has a cup face structure including the face 112 and walls 125 extending rearward from the face 112. The walls 125 include a sole portion 125A and a crown portion 125B, and terminate in a rear face 190 substantially opposed to the face 112. The backbody member 129 is detachably attached to the rear face 190 of the face frame member 128. In the embodiment shown in FIGS. 16-17, the backbody member 129 extends over the entire rear face 190 of the face frame member 128 and over a portion of the sole 118 of the head 502. As best shown in FIG. 16, portions of the exterior sole portion 125A of the backbody member 129 extend on either side of the sole portion 125A of the face frame member 128.

Three fasteners 174 mechanically fasten the backbody member 129 to the face frame member 128. The fasteners 174 generally extend perpendicular to the sole portion 125A, i.e., vertically when the head 502 is in the striking position. Although three fasteners are shown, fewer or more fasteners may be used to attach the backbody member 129 to the face frame member 128.

As shown in FIG. 17, the rear face 190 may be shaped or contoured to accommodate the attachment of the backbody member 129, for example, the rear face 190 may include bosses for accommodating the fasteners 174. In this embodiment, the backbody member 129 is shaped as a substantially shell-like structure such that an internal concavity is defined therein. Thus, when the backbody member 129 is attached to the face frame member 128, an enclosed or a substantially enclosed secondary body cavity is formed therebetween.

As described above with respect to the head 102 shown in FIGS. 1-3, the backbody members 129 of the heads 202, 302, 402, 502 described above can be removed and reconnected, which can not only allow for adjustment of the stiffening element, but also for interchanging of the head 102 with one of a plurality of different heads 202, 302, 402, 502. As also described above, the heads 202, 302, 402, 502 may include a gasket, such as the gasket 130 described above, which can be removable and interchangeable as well. Still other embodiments of ball striking heads may have portions of the head that are removable by other mechanisms and using other structural configurations, and it is understood that such embodiments are included within the scope of the invention.

It is understood that the ball striking heads 102, et seq. described herein may have additional features affecting the flexibility of the face or areas thereof. For example, the heads 102, et seq. may have areas of relatively increased or decreased face thickness. Additionally, the heads 102, et seq. described herein may contain a greater or smaller number of stiffening elements, creating additional areas of relative stiffness and flexibility. It is contemplated that in embodiments with multiple stiffening elements, various ones of the stiffening elements may be formed of different materials or may be strengthened or otherwise designed with specific properties through processing techniques.

Heads 102, et seq. incorporating the stiffening elements 140, et seq. disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the head 102 may include attachment of a backbody member 129 to a face frame member 128, as described above. Additionally, the head 102, et seq., golf club 100, or other ball striking device may be fitted or customized for a person by adjusting the stiffening element 140, et seq. Such adjustment may include manual or mechanical manipulation of the stiffening element 140, et seq. In some embodiments, as described above, adjusting the stiffening element may include removal of a portion of the head, such as removal of the backbody member 129. Further, in some embodiments, customization of the head 102, et seq., golf club 100, or other ball striking device may include removing the backbody member 129 and/or the gasket 130 and replacement with one of a plurality of other different backbody members and/or gaskets.

The ball striking devices and heads therefor as described herein provide many benefits and advantages over existing products. For example, the stiffening elements can be strategically located and adjusted to provide local stiffness and flexibility in the face of the head so that certain areas of the face will have a COR that is higher than other areas, without exceeding COR limits set by regulatory authorities. The head can be configured and adjusted so that the areas of the face that most frequently impact the ball during play will have a higher COR. A ball impacting these specific locations on the face will have more energy and velocity transferred to it, thus resulting in longer hits. Additionally, the location of the stiffening element and the resultant areas of local stiffness and flexibility can affect the direction, trajectory, and spin of an impacted ball. Thus, the head can be further configured and adjusted so that areas of the face that most frequently impact the ball during play will produce straighter and truer flight of the ball.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having an outer surface configured for striking a ball and an inner surface opposite the outer surface;

a body connected to the face;

a pivot member connected to the inner surface of the face and defining a pivot point spaced from the face; and a moveable stiffening element rotatably mounted to the pivot member at the pivot point, the stiffening element comprising an arm extending outwardly from the pivot point and spaced from the inner surface of the face and an engaging member at a distal end of the arm, the engaging member engaging a contact point on the inner surface of the face, and wherein the arm is movable by rotating the stiffening element about the pivot member to change a location of the contact point on the inner surface of the face.

2. The golf club head of claim 1, wherein the movable stiffening element engages a plurality of contact points on the inner surface of the face.

3. The golf club head of claim 2, wherein movement of the stiffening element changes at least one of the plurality of contact points.

4. The golf club head of claim 2, wherein movement of the stiffening element changes all of the plurality of contact points.

5. The golf club head of claim 1, wherein the movable stiffening element has a plurality of arms extending outwardly from the pivot point and spaced from the inner surface of the face, each arm having an engaging member at a distal end thereof to engage a plurality of contact points on the inner surface of the face, wherein the arms are movable by rotating the stiffening element about the pivot member to change locations of the contact points on the inner surface of the face.

6. The golf club head of claim 5, wherein the movable stiffening element has four arms extending outwardly from the pivot point and arranged in an X-shape and four engaging members, each of the arms having one of the engaging members positioned proximate the distal end thereof and engaging one of the contact points.

7. The golf club head of claim 5, wherein the movable stiffening element has three arms extending outwardly from the pivot point and arranged in a Y-shape and three engaging members, each of the arms having one of the engaging members positioned proximate the distal end thereof and engaging one of the contact points.

8. The golf club head of claim 1, wherein the movable stiffening element provides increased stiffness to an area of the face proximate the contact point.

9. The golf club head of claim 1, wherein the pivot member comprises a threaded pin, and the movable stiffening element is connected to the pivot member by a threaded connection to the threaded pin.

10. The golf club head of claim 1, wherein at least a portion of the body is removable to provide access to the movable stiffening element.

11. The golf club head of claim 1, further comprising:

a face member comprising the face and a wall extending rearward from the face; and a backbody member connected to the wall of the face member, wherein the backbody member and at least a portion of the wall of the face member define the body, wherein the backbody member is removable to provide access to the movable stiffening element.

12. The golf club head of claim 11, further comprising:

a plurality of different backbody members, each configured to be connected to the wall of the face member; and a plurality of different gaskets, each configured to be positioned between one or more of the backbody members and the wall of the face member when the respective backbody member is connected to the face member, wherein each of the backbody members and each of the gasket members are removable and interchangeable after connection to the face member.

13. A golf club comprising the golf club head of claim 1 and a shaft connected to the golf club head.

14. A face member for use in a ball striking device, comprising:

a face having an outer surface configured for striking a ball and an inner surface located rearward and opposite of the outer surface;

a wall extending rearward from an outer periphery of the face;

a pivot member connected to the inner surface of the face and defining a pivot point spaced from the face; and a moveable stiffening element rotatably mounted to the pivot member at the pivot point, the stiffening element comprising an arm extending outwardly from the pivot point and spaced from the inner surface of the face and an engaging member at a distal end of the arm, the engaging member engaging a contact point on the inner surface of the face to provide increased stiffness to an area of the face proximate the contact point, and wherein the arm is movable by rotating the stiffening element about the pivot member to change a location of the contact point on the inner surface of the face.

15. The face member of claim 14, wherein the movable stiffening element engages a plurality of contact points on the inner surface of the face.

16. The face member of claim 15, wherein movement of the stiffening element changes at least one of the plurality of contact points.

17. The face member of claim 15, wherein movement of the stiffening element changes all of the plurality of contact points.

18. The face member of claim 14, wherein the movable stiffening element has a plurality of arms extending outwardly from the pivot point and spaced from the inner surface of the face, each arm having an engaging member at a distal end thereof to engage a plurality of contact points on the inner surface of the face, wherein the arms are movable by rotating the stiffening element about the pivot member to change locations of the contact points on the inner surface of the face.

19. The face member of claim 14, wherein the pivot member comprises a threaded pin, and the movable stiffening element is connected to the pivot member by a threaded connection to the threaded pin.

20. A method for use with a golf club head including a face having an outer surface configured for striking a ball and an inner surface opposite the outer surface, a body connected to the face, a pivot member connected to the inner surface of the face and defining a pivot point spaced from the face, and a moveable stiffening element rotatably mounted to the pivot member at the pivot point, the stiffening element comprising an arm extending outwardly from the pivot point and spaced from the inner surface of the face and an engaging member at a distal end of the arm, the engaging member engaging a contact point on the inner surface of the face to provide increased stiffness to an area of the face proximate the contact point, the method comprising:

moving the stiffening element by rotating the stiffening element about the pivot member to change a location of the contact point on the inner surface of the face.

21. The method of claim 20, wherein the movable stiffening element engages a plurality of contact points on the inner surface of the face, and wherein moving the stiffening element changes at least one of the plurality of contact points.

22. The method of claim 21, wherein moving the stiffening element changes all of the plurality of contact points.

23. The method of claim 20, further comprising:

attaching a shaft to the golf club head to form a golf club.

24. The method of claim 20, wherein the stiffening element is adapted for engagement by a tool, and wherein moving the stiffening element includes moving the stiffening element using the tool.

25. The method of claim 20, wherein a portion of the body is removable to provide access to the movable stiffening element, the method further comprising:

removing the portion of the body prior to moving the stiffening element; and reconnecting the portion of the body subsequent to moving the stiffening element.

26. The method of claim 20, wherein the golf club head further comprises a face member, including the face and a wall extending rearward from the face, and a backbody member connected to the wall of the face member, wherein the backbody member and at least a portion of the wall of the face member define the body, and wherein the backbody member is removable to provide access to the movable stiffening element, the method further comprising:

removing the backbody member prior to moving the stiffening element; and reconnecting the backbody member subsequent to moving the stiffening element.

27. The method of claim 20, wherein the golf club head further comprises a face member, including the face and a wall extending rearward from the face, a backbody member connected to the wall of the face member, and a gasket positioned between the backbody member and the wall of the face member, wherein the backbody member and at least a portion of the wall of the face member define the body, and wherein the backbody member is removable to provide access to the movable stiffening element, the method further comprising:

removing at least one of the backbody member and the gasket; and replacing the at least one of the backbody member and the gasket with at least one of a replacement backbody member and a replacement gasket.

28. A golf club head comprising:

a face having an outer surface configured for striking a ball and an inner surface opposite the outer surface;

a body connected to the face; and a rotatable stiffening element connected to the inner surface of the face and being rotatable about a pivot point, the stiffening element having an arm extending from the pivot point and engaging the inner surface of the face at a contact point spaced from the pivot point to create an area of increased stiffness on the face, wherein the stiffening element is rotatable about the pivot point to move the arm about the pivot point and change a location of the contact point on the inner surface of the face.

29. The golf club head of claim 28, wherein the stiffening element further comprises a plurality of arms extending from the pivot point, the arms engaging the inner surface of the face at a plurality of separate contact points spaced from the pivot point to create a plurality of areas of increased stiffness on the face, wherein the stiffening element is rotatable about the pivot point to move the arms about the pivot point and change locations of the contact points on the inner surface of the face.

30. A golf club head comprising:

a face member comprising a face having an outer surface configured for striking a ball, an inner surface opposite the outer surface, and a wall extending rearward from the face;

a plurality of different backbody members, each configured to be connected to the wall of the face member, such that the backbody member and at least a portion of the wall of the face member define a body connected to the face;

a plurality of different gaskets, each configured to be positioned between one or more of the backbody members and the wall of the face member when the respective backbody member is connected to the face member; and a rotatable stiffening element connected to the inner surface of the face and being rotatable about a pivot point, the stiffening element having an arm extending from the pivot point and engaging a contact point on the inner surface of the face spaced from the pivot point wherein the stiffening element is rotatable about the pivot point to move the arm about the pivot point and change a location of the contact point on the inner surface of the face, and wherein each of the backbody members and each of the gasket members are removable and interchangeable after connection to the face member to provide access to the movable stiffening element.

31. A method for use with a golf club head including a face member including a face having an outer surface configured for striking a ball and a wall extending rearward from the face, a backbody member connected to the wall of the face member, wherein the backbody member and at least a portion of the wall of the face member define a body connected to the face, and a rotatable stiffening element connected to an inner surface of the face and being rotatable about a pivot point, the stiffening element having an arm extending from the pivot point and engaging a contact point on the inner surface of the face spaced from the pivot point to provide increased stiffness to an area of the face proximate the contact point, wherein the backbody member is removable to provide access to the movable stiffening element, the method comprising:

removing at least one of the backbody member and the gasket;

moving the stiffening element to change the contact point on the inner surface of the face; and replacing the at least one of the backbody member and the gasket with at least one of a replacement backbody member and a replacement gasket.

32. A golf club head comprising:

a face having an outer surface configured for striking a ball and an inner surface opposite the outer surface;

a body connected to the face;

a pin connected to the inner surface of the face; and a stiffening element connected to the pin at a connection point, such that the pin moveably mounts the stiffening element to the inner surface of the face to permit movement of the stiffening element with respect to the inner surface of the face, the stiffening member including a plurality of engaging members engaging a plurality of contact points on the inner surface of the face, each engaging member providing increased stiffness to an area of the face proximate the respective contact point, wherein movement of the stiffening element changes a location of each of the contact points on the inner surface of the face.

* * * * *